US009321264B2

(12) United States Patent
Hirai et al.

(10) Patent No.: US 9,321,264 B2
(45) Date of Patent: Apr. 26, 2016

(54) LIQUID EJECTION APPARATUS AND METHOD FOR MANUFACTURING LIQUID EJECTION APPARATUS

(71) Applicant: BROTHER KOGYO KABUSHIKI KAISHA, Nagoya-shi, Aichi-ken (JP)

(72) Inventors: Keita Hirai, Nagoya (JP); Hirota Atsushi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/665,645

(22) Filed: Mar. 23, 2015

(65) Prior Publication Data

US 2015/0273832 A1 Oct. 1, 2015

(30) Foreign Application Priority Data

Mar. 26, 2014 (JP) ..... 2014-063831

(51) Int. Cl.
*B41J 2/045* (2006.01)
*B41J 2/14* (2006.01)
*B41J 2/16* (2006.01)

(52) U.S. Cl.
CPC ..... *B41J 2/14233* (2013.01); *B41J 2/1607* (2013.01); *B41J 2/1623* (2013.01); *B41J 2/1637* (2013.01); *B41J 2002/14459* (2013.01); *B41J 2002/14491* (2013.01); *Y10T 156/1043* (2015.01)

(58) Field of Classification Search
CPC .. B41J 2/14233; B41J 2/1623; B41J 2/14209; B41J 2/161; B41J 2/1632
USPC ..... 347/71, 58, 59, 68, 72
See application file for complete search history.

(56) References Cited

U.S. PATENT DOCUMENTS

| | | | | |
|---|---|---|---|---|
| 2006/0055742 | A1 | 3/2006 | Yokouchi | |
| 2007/0035589 | A1 | 2/2007 | Takahashi et al. | |
| 2007/0052764 | A1 | 3/2007 | Oku | |
| 2008/0218556 | A1 * | 9/2008 | Seto et al. | 347/50 |
| 2009/0237464 | A1 * | 9/2009 | Owaki et al. | 347/68 |
| 2010/0156997 | A1 | 6/2010 | Young et al. | |

FOREIGN PATENT DOCUMENTS

| | | | |
|---|---|---|---|
| EP | 1 997 637 | A1 | 12/2008 |
| EP | 2 535 189 | A1 | 12/2012 |
| JP | 2006-082343 | A | 3/2006 |
| JP | 2007-045129 | A | 2/2007 |

OTHER PUBLICATIONS

European Search Report issued in related European Application No. 15160851.0, mailed Aug. 24, 2015.

* cited by examiner

*Primary Examiner* — Manish S Shah
*Assistant Examiner* — Yaovi Ameh
(74) *Attorney, Agent, or Firm* — Merchant & Gould P.C.

(57) ABSTRACT

A liquid ejection apparatus comprising: a nozzle; a pressure chamber communicating with the nozzle; a laminated body including a piezoelectric element, the laminated body covering the pressure chamber, the laminated body defining a communications opening therethrough; a reservoir communicating with the pressure chamber via the communication opening; a wall extending from the laminated body so as to extend around the communication opening, the wall including a conductive portion; a drive contact electrically connected to the piezoelectric element by a conductor including the conductive portion of the wall.

21 Claims, 11 Drawing Sheets

LIQUID EJECTION APPARATUS AND METHOD FOR MANUFACTURING LIQUID EJECTION APPARATUS

CROSS-REFERENCE TO RELATED APPLICATION

This application claims priority from Japanese Patent Application No. 2014-063831 filed on Mar. 26, 2014, which is incorporated herein by reference in its entirety.

FIELD OF DISCLOSURE

The disclosure relates to a liquid ejection apparatus configured to eject liquid and a method for manufacturing the liquid ejection apparatus.

BACKGROUND

A liquid ejection apparatus, e.g., an inkjet head, includes a channeled substrate and a reservoir formation substrate. The channeled substrate includes a plurality of pressure chambers and a communication portion that is shared by the pressure chambers and communicates with the pressure chambers. A vibration plate is disposed on the upper surface of the channeled substrate, to cover the pressure chambers and the communication portion. The vibration plate includes a plurality of piezoelectric elements in correspondence with the pressure chambers. A nozzles plate is disposed at the lower surface of the channeled substrate opposite to the vibration plate. The nozzles plate has a plurality of nozzles communicating with the respective pressure chambers.

The reservoir formation substrate is disposed above the channeled substrate to cover the piezoelectric elements. The reservoir formation substrate is bonded with an adhesive at an area of the vibration plate outside the piezoelectric elements. The reservoir formation substrate includes a reservoir portion. The reservoir portion communicates with the communication portion of the channeled substrate, via a communication opening formed in the vibration plate. Ink in the reservoir portion is supplied to the communication portion of the channeled substrate. In the channeled substrate, the ink is distributed from the communication portion to the pressure chambers.

Contact portions protruding from the vibration plate are disposed at bonding areas of the vibration plate with the reservoir formation substrate outside the piezoelectric elements. A band-like contact portion is disposed all around an end portion or an edge portion of the channeled substrate. Another band-like contact portion is disposed around the communication opening of the vibration plate. The communication opening brings the reservoir portion of the reservoir formation substrate and the communication portion of the channeled substrate into communication with each other. The reservoir formation substrate is bonded to the vibration plate with an adhesive while being pressed against the contact portions. Thus, the channeled substrate and the reservoir formation substrate are favorably bonded.

Each contact portion includes a laminated body having the same layer structure as the piezoelectric element. More specifically, each contact portion includes a piezoelectric layer and two kinds of electrode layers sandwiching the piezoelectric layer from above and below. The layers of the contact portion are separated from those of the piezoelectric element. In other words, the electrode layers included in the contact portion are separated from the electrodes of the piezoelectric element.

In the liquid ejection apparatus, a channel portion (e.g., communication portion) configured to distribute ink to the pressure chambers is formed on a lower channeled structure (e.g., the channeled substrate), together with the pressure chambers. In other words, ink is supplied from an upper channeled structure (e.g., the reservoir formation substrate) to the communication portion of the lower channeled structure (e.g., the channeled substrate), via the communication opening formed on the vibration plate. Thereafter, in the lower channeled structure, ink is distributed to the pressure chambers.

SUMMARY

According to an aspect of the disclosure, a liquid ejection apparatus includes a nozzle and a pressure chamber communicating with the nozzle. A laminated body has a piezoelectric element and the laminated body covers the pressure chamber. The laminated body defines a communications opening therethrough. A reservoir communicates with the pressure chamber via the communication opening. A wall extends from the laminated body so as to extend around the communication opening. The wall has a conductive portion. A drive contact electrically connects to the piezoelectric element by a conductor including the conductive portion of the wall.

BRIEF DESCRIPTION OF THE DRAWINGS

Reference now is made to the following description taken in connection with the accompanying drawings.

DETAILED DESCRIPTION

Figure 1:
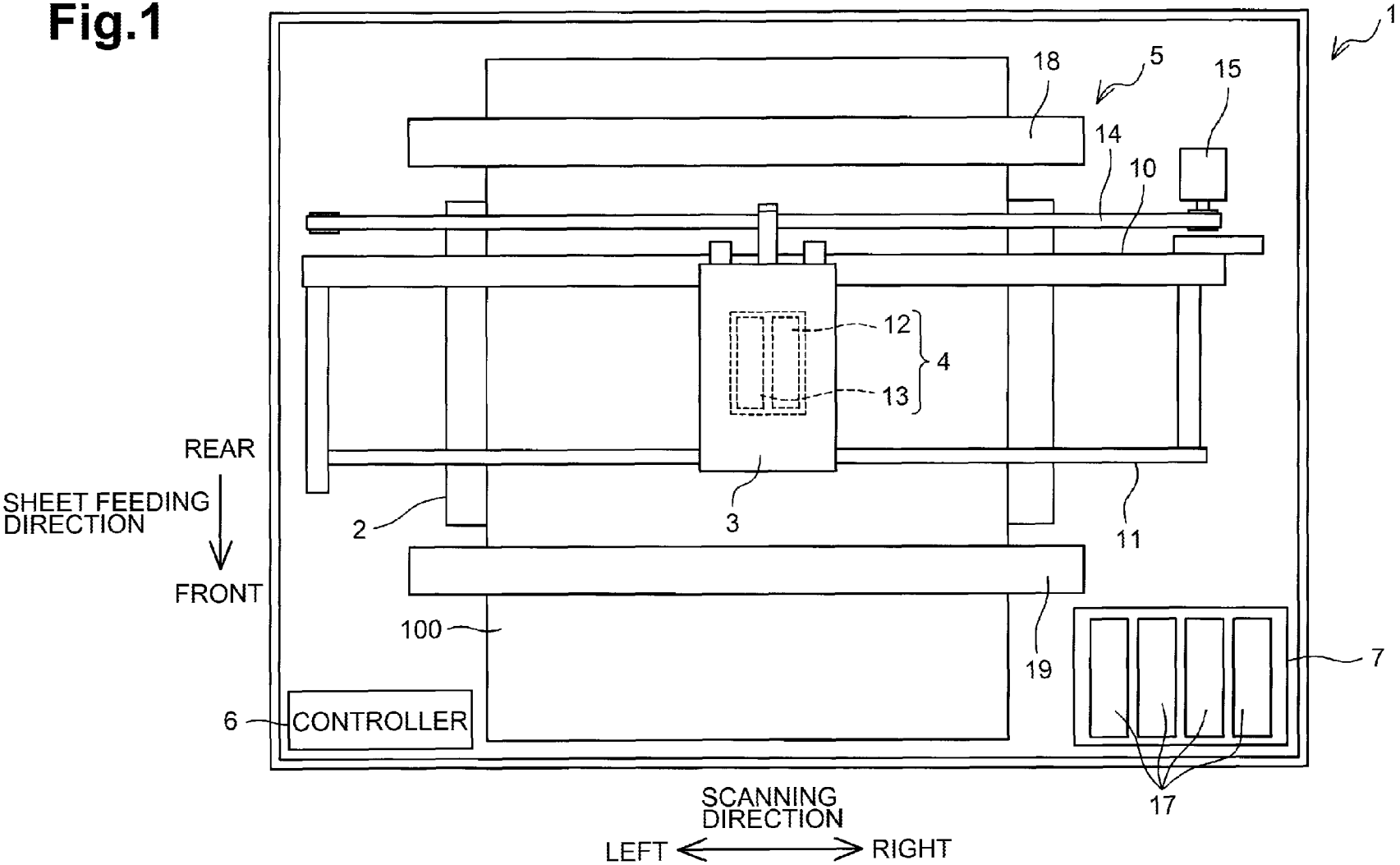
FIG. 1 is a plan view of a printer in an illustrative embodiment according to one or more aspects of the disclosure.

An illustrative embodiment of the disclosure will be described. FIG. 1 is a plan view of a printer in an illustrative embodiment according to one or more aspects of the disclosure. Referring to FIG. 1, general structures of an inkjet printer 1 will be described. The front, rear, left, and right sides of the printer 1 are defined as depicted in FIG. 1. The front or near side and the back side of the sheet of FIG. 1 are defined as the top/upper side and the bottom/lower side of the printer 1, respectively. Hereinafter, description will be made with reference to directions as defined above.

In some liquid ejection apparatuses, ink is individually supplied from the upper channeled structure to the pressure chambers of the lower channeled structure. In this case, however, a plurality of communication openings that communicate with the respective pressure chambers needs to be formed near the respective piezoelectric elements of the vibration plate. If a contact portion is to be provided around the communication opening to increase the sealability or effectiveness of seal in an area around the communication opening of the vibration plate as in the liquid ejection apparatus, such a contact portion as described above needs to be provided for each communication opening. As the communication opening and the contact portion are disposed at positions of the vibration plate adjacent to each piezoelectric element and a drive wiring extending from the electrode of each piezoelectric element is tried to route around to avoid the communication opening and the contact portion, an area where the drive wirings can be arranged may be reduced.

One or more aspects of the disclosure are, in a structure in which liquid is individually supplied from a second channeled structure to pressure chambers of a first channeled structure, to improve the sealability or effectiveness of seal for an area around each communication opening of the vibration plate to which the second channeled structure is bonded, and to ensure an area for a wiring routed or extending from each piezoelectric element.

(General Structures of Printer)

As depicted in FIG. 1, the inkjet printer 1 includes a platen 2, a carriage 3, an inkjet head 4, a feeding mechanism 5, and a controller 6.

A recording medium, e.g., a recording sheet 100, is placed on the upper surface of the platen 2. The carriage 3 is configured to reciprocate along two guide rails 10 and 11 in a scanning direction at a region opposing the platen 2. An endless belt 14 is connected to the carriage 3. As a carriage drive motor 15 drives the endless belt 14, the carriage 3 moves in the scanning direction.

The inkjet head 4 is mounted on the carriage 3. The inkjet head 4 is configured to move together with the carriage 3 in the scanning direction. The inkjet head 4 is connected by tubes (not depicted) to a cartridge holder 7 on which ink cartridges 17 of four colors (e.g., black, yellow, cyan, and magenta) are mounted. The inkjet head 4 includes head units 12 and 13 arranged in the scanning direction. Each head unit 12 and 13 has a plurality of nozzles 24 (refer to FIGS. 2-5D) formed on the lower surface thereof (e.g., the back side of the sheet of FIG. 1). The nozzles 24 are configured to eject ink toward the recording sheet 100 placed on the platen 2. In the two head units 12 and 13, one head unit 12 is configured to eject black and yellow inks. The other head unit 13 is configured to eject cyan and magenta inks.

The feeding mechanism 5 includes two feeding rollers 18 and 19 interposing the platen 2 therebetween in a sheet feeding direction. The feeding mechanism 5 is configured to feed the recording sheet 100 placed on the platen 2 in the sheet feeding direction with the two feeding rollers 18 and 19.

The controller 6 includes a read only memory (ROM), a random access memory (RAM), and an application specific integrated circuit (ASIC) comprising various control circuits. The controller 6 is configured to execute various processing, e.g., printing onto the recording sheet 100, based on programs stored in the ROM, with the ASIC. For example, in print processing, the controller 6 controls, for example, the head units 12 and 13 of the inkjet head 4 and the carriage drive motor 15, based on a print instruction input from an external device, e.g., a personal computer (PC), to print, for example, an image, onto the recording sheet 100. More specifically, an ink ejection operation and a feeding operation are alternately performed. In the ink ejection operation, ink is ejected while the inkjet head 4 is moved together with the carriage 3 in the scanning direction. In the feeding operation, the recording sheet 100 is fed in the sheet feeding direction by a predetermined amount by the feeding rollers 18 and 19.

(Details of Head Units of Inkjet Head)

Figure 2:
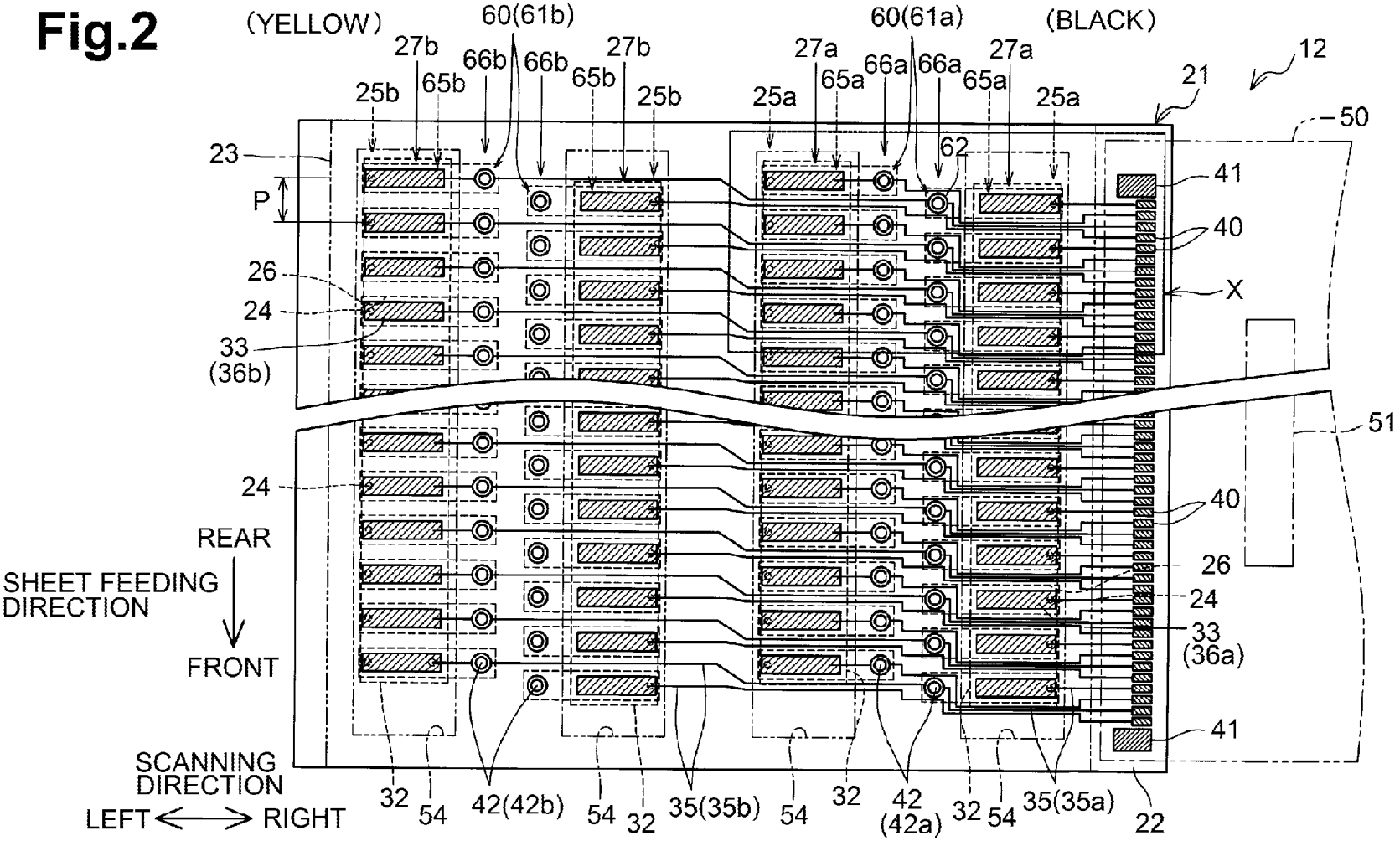
FIG. 2 is a top view of a head unit of an inkjet head.
Figure 3:
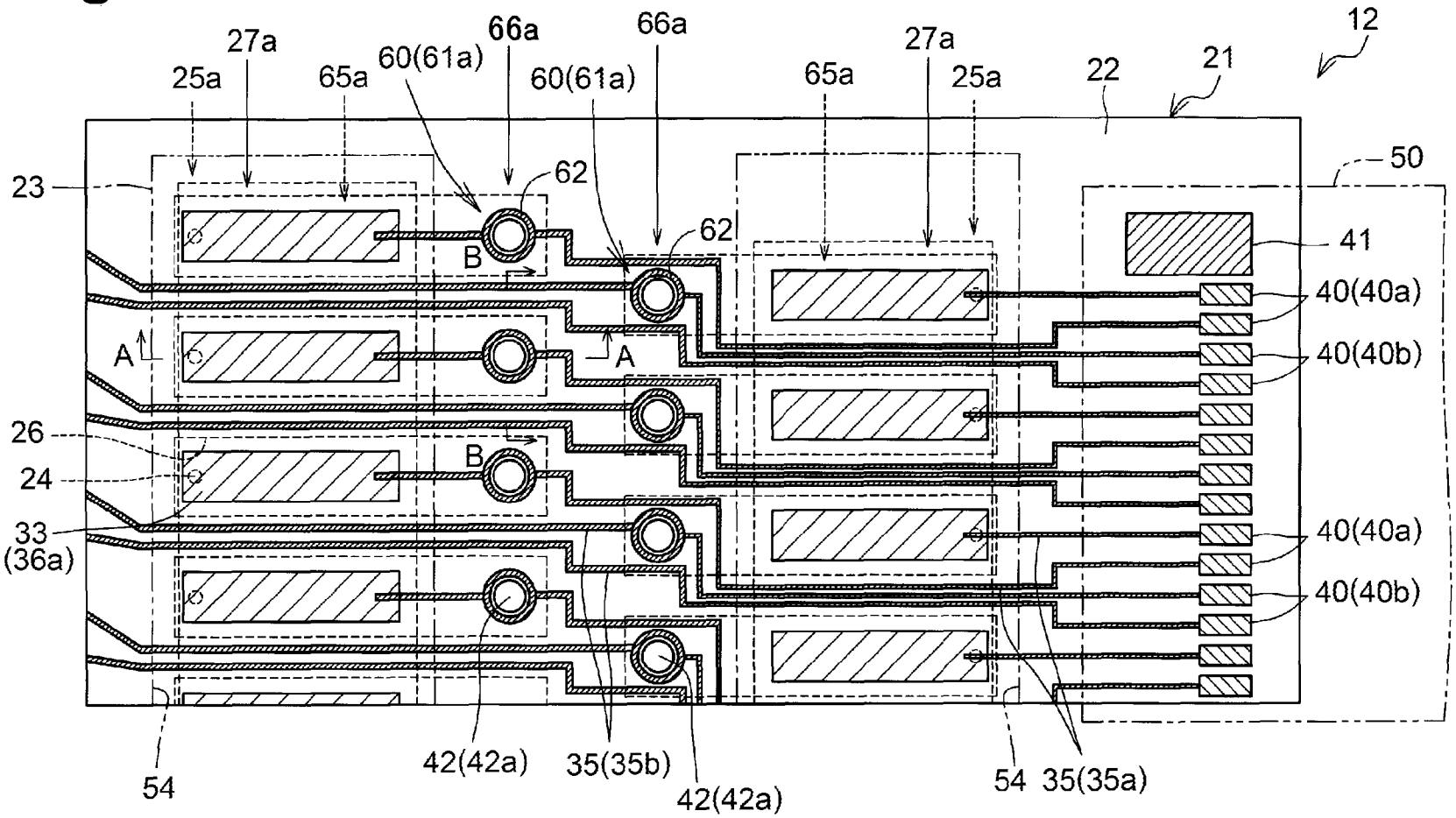
FIG. 3 is an enlarged view of a portion "X" of the head unit of FIG. 2.
Figure 4A:
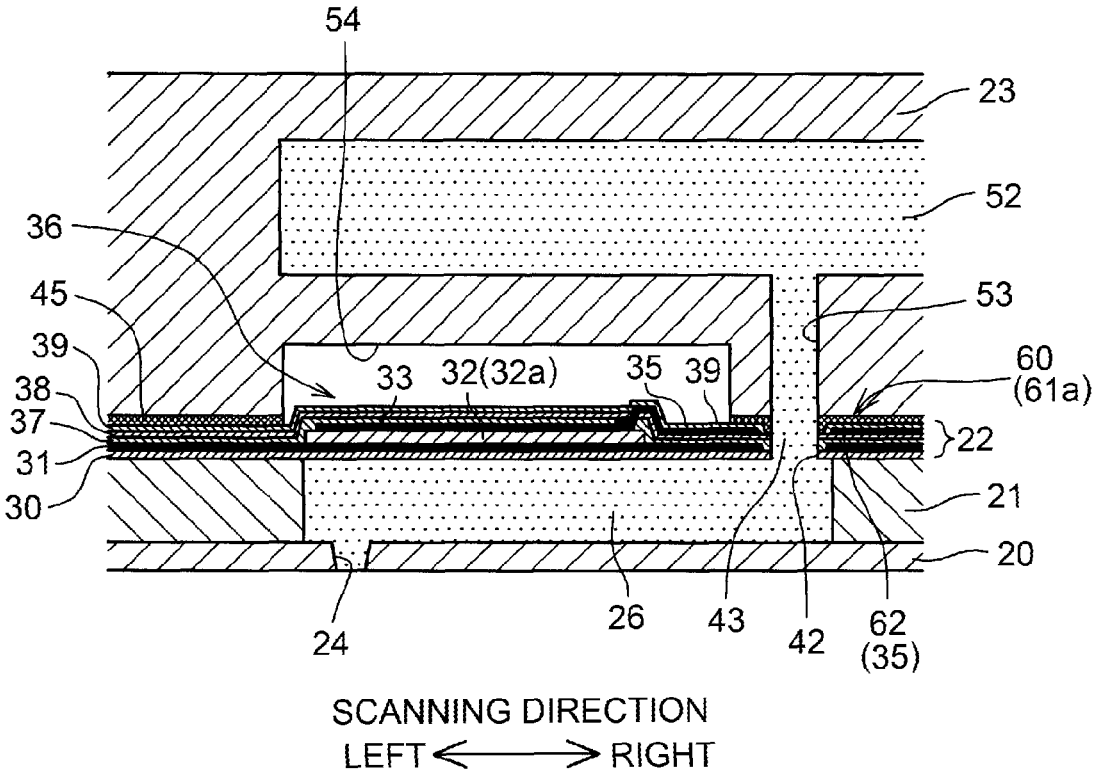
FIG. 4A is a cross-sectional view of the head unit, taken along the line A-A of FIG. 3.
Figure 4B:
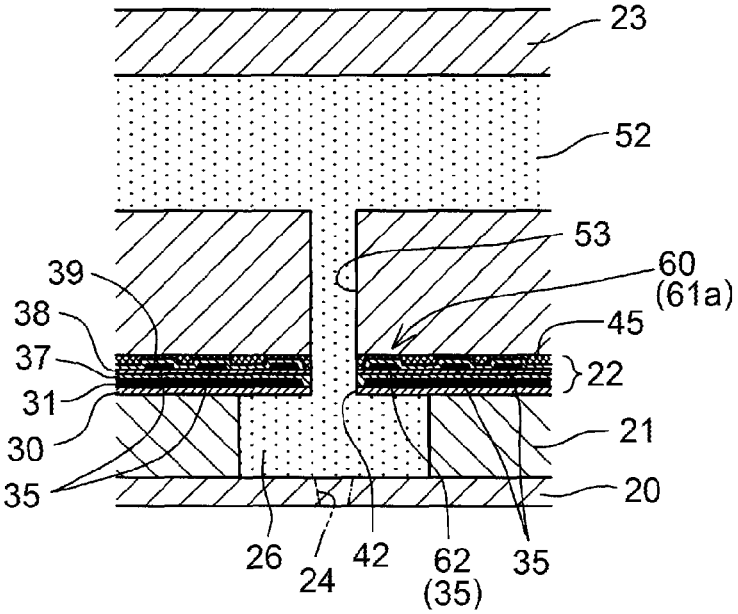
FIG. 4B is a cross-sectional view of the head unit, taken along the line B-B of FIG. 3.

Next, structures of the head units 12 and 13 of the inkjet head 4 will be described in detail. The two head units 12 and 13 have similar structures. Therefore, description will be made in conjunction with the head unit 12 configured to eject black and yellow inks. FIG. 2 is a top view of the head unit 12 of the inkjet head 4. FIG. 3 is an enlarged view of a portion "X" of the head unit of FIG. 2. FIG. 4A is a cross-sectional view of the head unit 12, taken along the line A-A of FIG. 3. FIG. 4B is a cross-sectional view of the head unit 12, taken along the line B-B of FIG. 3. As depicted in FIGS. 2-4B, the head unit 12 includes a nozzles plate 20, a channeled member 21, a laminated body 22, and a reservoir formation member 23. In FIGS. 2 and 3, an outline of the reservoir formation member 23 disposed above the channeled member 21 and the laminated body 22 is illustrated by chain double-dashed lines, for the sake of simplification of the drawings.

(Nozzles Plate)

The nozzles plate 20 is formed of, for example, metallic material, e.g., stainless steel, silicon, or synthetic resin material, e.g., polyimide. As depicted in FIG. 4A, the nozzles plate 20 has the nozzles 24. The nozzles 24 are arranged on the nozzles plate in the sheet feeding direction. The nozzles 24 constitute four nozzle rows 25 arranged in the scanning direction. Right two nozzle rows 25*a* are configured to eject black ink. Positions of the nozzles 24 of the two nozzle rows 25*a* are mutually deviated in the sheet feeding direction by a half of the alignment pitch P (P/2) for each nozzle row 25. Left two nozzle rows 25*b* are configured to eject yellow ink. Similar to the nozzle rows 25*a* for black ink, positions of the nozzles 24 of the two nozzle rows 25*b* for yellow ink are mutually deviated in the sheet feeding direction by a half pitch (P/2).

(Channeled Member)

The channeled member 21 is formed of silicon. The nozzles plate 20 is bonded to the lower surface of the channeled member 21. The channeled member 21 includes a plurality of pressure chambers 26 communicating with the corresponding nozzles 24. Each pressure chamber 26 has a rectangular planar shape elongated in the scanning direction. The pressure chambers 26 are arranged in the sheet feeding direction in association with the nozzles 24. The pressure chambers 26 constitute four pressure chamber rows 27 arranged in the scanning direction. The right two pressure chamber rows 27*a* are for black ink and left two pressure chamber rows 27*b* are for yellow ink. In the left pressure chamber row 27 of the two pressure chamber rows 27*a* (or 27*b*) configured to eject the same color of ink, a left end portion of each pressure chamber 26 and the corresponding nozzle 24 overlap with each other. In the right pressure chamber row 27 of the two pressure chamber rows 27*a* (or 27*b*) configured to eject the same color of ink, a right end portion of each pressure chamber 26 and the corresponding nozzle 24 overlap with each other. Positions of the pressure chambers 26 of the two pressure chamber rows 27*a* for black ink are mutually deviated in the sheet feeding direction by a half pitch (P/2). Positions of the pressure chambers 26 of the two pressure chamber rows 27*b* for yellow ink are also mutually deviated in the sheet feeding direction by a half pitch (P/2).

(Laminated Body)

The laminated body 22 is configured to apply, to ink in the pressure chambers 26, ejection energy for ejecting ink from the respective nozzles 24. The laminated body 22 is disposed at the upper surface of the channeled member 21. As depicted in FIGS. 2-4B, the laminated body 22 includes, for example, a vibration plate 30, a common electrode 31, a piezoelectric layer 32, individual electrodes 33, and a drive wiring 35, in layers. As will be briefly described later, the laminated body 22 is formed by sequentially laminating each layer by a known semiconductor process technique on the upper surface of a silicon substrate, which becomes the channeled member 21.

The vibration plate 30 is disposed at the entire upper surface of the channeled member 21 to cover the pressure chambers 26. The vibration plate 30 is formed of, for example, silicon dioxide film (SiO2) or silicon nitride film (SiN). The vibration plate 30 has a communication opening 42 formed at an end portion thereof opposite to the nozzles 24 of the pressure chambers 26 in the scanning direction.

The common electrode 31 is formed of conductive material. The common electrode 31 is formed almost at an entire upper surface of the vibration plate 30 across the pressure chambers 26.

Four pieces of the piezoelectric layer 32 are disposed at the upper surface of the vibration plate 30 having the common electrode 31 formed thereon in correspondence with the four pressure chamber rows 27. Each piece of the piezoelectric layer 32 extends in the sheet feeding direction across the pressure chambers 26 constituting the one pressure chamber row 27. The piezoelectric layer 32 is formed of piezoelectric material having a main component of, for example, lead zirconate titanate, which is a mixed crystal of lead titanate and lead zirconate.

A plurality of the individual electrodes 33 is formed at portions of the upper surface of the piezoelectric layer 32 that overlap the respective pressure chambers 26. Each individual electrode 33 has a planar rectangular shape elongated in the scanning direction.

A portion of the piezoelectric layer 32 sandwiched between the individual electrodes 33 and the common electrode 31 is polarized downward in a thickness direction of the piezoelectric layer 32 e.g., a direction from the individual electrodes 33 toward the common electrode 31. The polarized portion of the piezoelectric layer 32 is referred to as the active portion 32*a*. The one active portion 32*a* of the piezoelectric layer 32, and the individual electrode 33 and the common electrode 31 that sandwich the active portion 32*a* constitute one piezoelectric element 36 disposed opposite to the one pressure chamber 26, relative to the vibration plate 30.

As depicted in FIGS. 4A and 4B, two protective layers 37 and 38 are formed on the upper surface of the vibration plate 30, to cover the common electrode 31, the piezoelectric layer 32, and the individual electrodes 33. The protective layers 37 and 38 are not illustrated in FIGS. 2 and 3 for the sake of simplicity. The protective layer 37 includes an insulator formed of, for example, alumina ($Al_2O_3$) or silicon nitride film. The protective layer 38 includes an insulator formed of, for example, silicon dioxide film. The protective layers do not have to include two protective layers 37 and 38 but may include, for example, one protective layer 38 formed of silicon dioxide film.

A plurality of the drive wirings 35 is disposed on a side opposite to the pressure chambers 26 relative to the vibration plate 30. More specifically, the drive wirings 35 are disposed at the upper surface of the protective layer 38. One end of each drive wiring 35 is connected to the upper surface of a right end portion of the individual electrode 33. Each drive wiring 35 extends rightward from the individual electrode 33. The drive wirings 35 are covered by a protective layer 39 including an insulator formed of, for example, silicon dioxide film. In FIGS. 2 and 3, the protective layer 39 is not illustrated. As depicted in FIGS. 2 and 3, a plurality of drive contact portions 40 (40*a*, and 40*b*) is arranged in one row along the sheet feeding direction at the upper surface of a right end portion of the laminated body 22. The drive wirings 35 extending rightward from the respective individual electrodes 33 are connected to the respective drive contact portions 40 positioned at right end portions of the channeled member 21. A ground contact portion 41 disposed at each side of the drive contact portions 40 in the sheet feeding direction is connected to the common electrode 31.

As depicted in FIGS. 4A and 4B, each of the protective layers 37, 38 and 39 has an opening at an area corresponding to the communication opening 42 formed on the vibration plate 30, to overlap the communication opening 42 in the vertical direction. In other words, the laminated body 22 includes a communication channel 43 defined by the communication opening 42 of the vibration plate 30 and the openings formed on the protective layers 37, 38 and 39. As can be seen from FIGS. 3-4B, the communication channel 43 having the communication opening 42 of the vibration plate 30 is sized to fit within the pressure chamber 26 in plan view. A structure of a portion of the laminated body 22 around the communication channel 43 will be described in detail below.

As depicted in FIGS. 2 and 3, a wiring member, e.g., a chip on film (COF) 50, is bonded to the upper surface of a right end portion of the laminated body 22. A plurality of wirings formed on the COF 50 is electrically connected to the drive contact portions 40. A side of the COF 50 opposite to the laminated body 22 is connected to the controller 6 (refer to FIG. 1) of the printer 1. The driver IC 51 is mounted on the COF 50.

The driver IC 51 generates and outputs a drive signal for driving the piezoelectric element 36, based on a control signal sent from the controller 6. The drive signal output from the driver IC 51 is input to the drive contact portion 40, via a wiring of the COF 50, and supplied to the individual electrode 33 of each piezoelectric element 36, via the drive wiring 35 of the laminated body 22. The potential of the individual electrode 33 to which the drive signal is supplied changes between a predetermined drive potential and the ground potential. A ground wiring is formed on the COF 50. The ground wiring is electrically connected to the two ground contact portions 41 of the laminated body 22. Thus, the potential of the common electrode 31 connected to the ground contact portion 41 is constantly maintained at the ground potential.

Operations of the piezoelectric element 36 when a drive signal is supplied from the driver IC 51 will be described. When a drive signal is not supplied, the potential of the individual electrode 33 of the piezoelectric element 36 is at the ground potential, which is the same potential as the common electrode 31. In this state, as a drive signal is supplied to a certain individual electrode 33 of the piezoelectric element 36, and the drive potential is applied to the individual electrode 33, an electric field parallel to the thickness direction of the active portion 32*a* is applied to the active portion 32*a* of the piezoelectric element 36, due to the potential difference between the individual electrode 33 and the common electrode 31. The polarized direction of the active portion 32*a* and the direction of the electric field match. Therefore, the active portion 32*a* expands in its thickness direction, e.g., the polarized direction, and shrinks in its planar direction. In association with the shrinking deformation of the active portion 32*a*, the vibration plate 30 deforms convexly toward the pressure chamber 26. Thus, the volumetric capacity of the pressure chamber 26 is reduced and a pressure wave is generated in the pressure chamber 26. Accordingly, an ink droplet is ejected from the nozzle 24 communicating with the pressure chamber 26.

(Reservoir Formation Member)

The reservoir formation member 23 is disposed at a side (e.g., an upper side) opposite to the channeled member 21 relative to the laminated body 22. The reservoir formation member 23 is bonded to the upper surface of the laminated body 22 with an adhesive 45. The reservoir formation member 23 may be formed of, for example, silicon, similar to the channeled member 21, or other material than silicon, e.g., metallic material or synthetic resin material.

Two reservoirs 52 are formed at an upper half portion of the reservoir formation member 23. Each reservoir 52 extends in the sheet feeding direction. The two reservoirs 52 are arranged along the scanning direction. The two reservoirs 52 are connected by the tubes (not depicted) to the cartridge holder 7 (refer to FIG. 1) configured to hold the cartridges 17. Black ink is supplied to one of the two reservoirs 52 and yellow ink is supplied to the other one of the two reservoirs 52.

A plurality of ink supply channels 53 extending downward from each reservoir 52 is formed at a lower half portion of the reservoir formation member 23. Each ink supply channel 53 communicates with the corresponding communication channel 43 of the laminated body 22. Thus, ink is supplied to the pressure chambers 26 of the channeled member 21 from each reservoir 52, via the ink supply channels 53 and the communication channels 43. Four protective cover portions 54 of a concave or recessed shape is formed at a lower half portion of the reservoir formation member 23. Each protective cover portion 54 covers corresponding one of four piezoelectric element rows 65 of the laminated body 22.

(Structures of Surrounding of Communication Opening of Laminated Body)

Next, structures of a surrounding of the communication opening 42 (and the communication channel 43) of the laminated body 22 will be described in detail. As depicted in FIGS. 4A and 4B, the reservoir formation member 23 is bonded with the adhesive 45 to areas of the vibration plate 30 around the communication openings 42, via other layers of the laminated body 22, e.g., the insulating layers 37 and 38. Ink may leak from the communication openings 42 if the bonding of the reservoir formation member 23 at areas of the vibration plate 30 around the communication openings 42 is insufficient and the sealability or effectiveness of seal is reduced.

In the illustrative embodiment, a plurality of annular wall portions 60 is disposed at areas around the respective communication openings 42 of the vibration plate 30 to protrude upward from the upper surface of the protective layer 37 and surround the respective communication openings 42. The reservoir formation member 23 is bonded with the adhesive 45 while being pressed against the areas, around the communication openings 42 of the vibration plate 30, where annular wall portions 60 are disposed. In this structure, the reservoir formation member 23 is bonded to the vibration plate 30 (e.g., the laminated body 22) while being pressed against the annular wall portions 60 at areas around communication openings 42. Therefore, the sealability or effectiveness of seal around the communication openings 42 may be preferable, and ink leakage from the bonded portions may be prevented or reduced.

As depicted in FIG. 4B, each annular wall portion 60 includes an annular conductive portion 62 formed on the upper surface of the protective layer 38 at an area around the communication opening 42 of the vibration plate 30 to surround the communication opening 42 of the vibration plate 30. The annular wall portion 60 including the conductive portion 62 is hereinafter referred to as "the conductive wall portion 61". In the illustrative embodiment, all of the annular wall portions 60 are the conductive wall portions 61 including the conductive portions 62. In a modification as will be described later, some of the annular wall portions 60 might not include the conductive portion 62. The conductive portion 62 may reinforce a portion of the vibration plate 30 extending toward the pressure chamber 26 around the communication opening 42. In the illustrative embodiment, the conductive portion 62 is formed in an annular shape all around the communication opening 42. Thus, the sealability or effectiveness of seal around the communication opening 42 may be preferable, so that ink leakage may be reliably prevented or reduced. The planar shape of the conductive portion 62 is not limited to a particular shape as long as the conductive portion 62 surrounds the communication opening 42. The planar shape of the conductive portion 62 may be, for example, an elliptical shape, and a rectangular frame, in addition to a circular shape concentric with the communication opening 42 as depicted in FIG. 3.

Each conductive portion 62 of some of the conductive wall portions 61 among a plurality of the conductive wall portions 61 constitutes a portion of the one drive wiring 35 connecting one piezoelectric element 36 and one drive contact portion 40. In other words, a portion of the drive wiring 35 is disposed in the annular wall portion 60 and the drive wiring 35 is not disposed to avoid each annular wall portion 60. Thus, the annular wall portion 60 is disposed around the communication opening 42 to ensure a broader arrangement area for the drive wiring 35 near the communication opening 42 while the sealability or effectiveness of seal is increased or improved.

As depicted in FIGS. 4A and 4B, the conductive portion 62 of the conductive wall portion 61 is covered by the protective layer 39 formed of an insulating material. Therefore, occurrence of, for example, short-circuit, caused by the contact of ink leaked from the communication opening 42 to the conductive portion 62, which is a portion of the drive wiring 35, may be prevented or reduced. Further, a portion of the adhesive 45 for bonding the reservoir formation member 23 exists on a side closer to the communication opening 42 than the conductive portion 62. Therefore, the contact of ink to the conductive portion 62 may be reliably prevented or reduced.

Referring to FIGS. 2 and 3, which the conductive portions 62 of the conductive wall portions 61 among a plurality of the conductive wall portions 61 constitute portions of the drive wirings 35 will be described in detail below. First, the positional relationship between the piezoelectric elements 36, the drive contact portions 40, and the communication openings 42 of the vibration plate 30 will be described. Hereinafter, for the clarity of the description, "the first" will be put in front of the names of the components for black ink and "a" will be put at the end of the reference numeral, and "the second" will be put in front of the names of the components for yellow ink and "b" will be put at the end of the reference numeral. For example, the piezoelectric element 36 for yellow ink will be referred to as "the second piezoelectric element 36*b*." The communication opening 42 for black ink will be referred to as "the first communication opening 42*a*".

As depicted in FIG. 2, a plurality of first piezoelectric elements 36*a* for black ink disposed on the right side is arranged in correspondence with the arrangement of the pressure chambers 26, to form two first piezoelectric element rows 65*a*. Two rows of a plurality of first communication openings 42*a* for black ink are disposed at an area between the two first piezoelectric element rows 65*a*, to form two first communication opening rows 66*a*. Similarly, a plurality of second piezoelectric elements 36*b* for yellow ink disposed on the left side is arranged in in correspondence with the arrangement of the pressure chambers 26, to form two second piezoelectric element rows 65*b*. Two rows of a plurality of second communication openings 42*b* for yellow ink are disposed at an area between the two second piezoelectric element rows 65*b*, to form two second communication opening rows 66*b*.

In other words, the two first communication opening rows 66*a* for black ink are disposed to the right of one of the first piezoelectric element rows 65*a* disposed closer to the center of the laminated body 22 in the scanning direction and the two second piezoelectric element rows 65*b*, e.g., on a side closer to the drive contact portions 40. The two second communication opening rows 66*b* for yellow ink are disposed to the left of the two first piezoelectric element rows 65*a* and one of the second piezoelectric element rows 65*b* closer to the center of the laminated body 22 in the scanning direction, e.g., a side opposite to the drive contact portions 40.

In the above-described structure, all of the drive wirings 35 extend rightward from each of the piezoelectric elements 36 constituting the piezoelectric element rows 65, to connect to the corresponding drive contact portions 40 (e.g., first drive contact portions 40*a* for black ink, and second drive contact portions 40*b* for yellow ink) disposed across the first communication opening rows 66*a*. A plurality of first drive wirings 35*a* extending from one of the first piezoelectric element rows 65*a* disposed closer to the center of the laminated body 22 in the scanning direction, and a plurality of second drive wirings 35*b* extending from the two second piezoelectric element rows 65*b* extend rightward across the two first communication opening rows 66*a*. Therefore, an area to arrange lots of the drive wirings 35 is required near the first communication opening rows 66*a*.

In the illustrative embodiment, a first conductive wall portion 61*a* disposed around the first communication opening 42*a* includes the conductive portion 62 constituting a portion of the first drive wiring 35*a* or the second drive wiring 35*b* connecting the piezoelectric element 36 and the drive contact portion 40. More specifically, as depicted in FIG. 2, the conductive portion 62 around the first communication opening 42*a* belonging to the left-side first communication opening row 66*a* in the two first communication opening rows 66*a* constitutes a portion of the first drive wiring 35*a* extending from the first piezoelectric element 36*a* corresponding to the first communication opening 42*a*. The conductive portion 62 around the first communication opening 42*a* belonging to the right-side first communication opening row 66*a* in the two first communication opening rows 66*a* constitutes a portion of the second drive wiring 35*b* extending from the second piezoelectric element 36*b* corresponding to the second communication opening 42*b*. Thus, a portion of the drive wiring 35 is disposed in the first conductive wall portion 61*a* disposed around the first communication opening 42*a*, so that a broader area may be ensured near the first communication openings 42*a* for the drive wirings 35. Thus, both the first drive wirings 35*a* and the second drive wirings 35*b* may be readily disposed near the first communication openings 42*a*.

Near the second communication openings 42*b*, only the second drive wirings 35*b* are disposed. Therefore, there is room in the arrangement area for the drive wirings 35. The conductive portion 62 of a second conductive wall portion 61*b* corresponding to the second communication opening 42*b* may constitute a portion of the drive wiring 35, similar to the conductive portion 62 of the conductive wall portion 61 for the first communication opening 42*a*. In another embodiment, the conductive portion 62 may be an independent pattern that is not electrically connected to the drive wiring 35. In FIG. 2, the conductive portion 62 around the second communication opening 42*b* belonging to the left-side second communication opening row 66*b* in the two second communication opening rows 66*b* constitutes a portion of the second drive wiring 35*b*. The conductive portion 62 around the second communication opening 42*b* belonging to the right-side second communication opening row 66*b* is an annular-shaped independent pattern that is not electrically connected to the drive wiring 35.

In view of minimizing electrical resistance of a wiring from the drive contact portion 40 to the piezoelectric element 36, it is preferable that a wiring width of each drive wiring 35 be greater. Both the first drive wirings 35*a* and the second drive wirings 35*b* need to be disposed in an area corresponding to a right end portion of the vibration plate 30 near the first drive contact portions 40*a* and the second drive contact portions 40*b*. As depicted in FIG. 3, the wiring widths of the first drive wiring 35*a* and the second drive wiring 35*b* become narrower as the first drive wiring 35*a* and the second drive wiring 35*b* extend closer to the drive contact portions 40 disposed on the right side in the scanning direction. The conductive portion 62 constituting a portion of the drive wiring 35 is disposed at areas around the first communication opening 42*a* and the second communication opening 42*b*. In view of ensuring the sealability or effectiveness of seal around all of the communication openings 42, reduction in the width of any conductive portion 62 is not desirable. Therefore, the widths of the conductive portions 62 are equal in the first conductive wall portions 61*a* around the first communication openings 42*a* and the second conductive wall portions 61*b* around the second communication openings 42*b*.

As depicted in FIGS. 2 and 3, at an area between a pair of the adjacent first communication openings 42*a* in the sheet feeding direction constituting the first communication opening row 66*a*, another drive wiring 35 (e.g., a portion of the drive wiring 35) that is not electrically connected to the conductive portion 62 of the first conductive wall portion 61*a* in the same the first communication opening row 66*a* is disposed. Thus, the another drive wiring 35 is disposed at upstream and downstream sides of each first conductive wall portion 61*a* in the sheet feeding direction. The another drive wiring 35 is separately disposed to each side of one first conductive wall portion 61*a* in the sheet feeding direction. Therefore, when the reservoir formation member 23 is bonded with the adhesive 45 while being pressed against the vibration plate 30, pressing force may be applied equally to each side of the conductive wall portion 61. Accordingly, the sealability or effectiveness of seal around the first communication opening 42*a* may be increased.

The two drive wirings 35 are disposed to each side of the one first conductive wall portion 61*a*. In other words, the number of the another drive wirings 35 disposed to each side of the one first conductive wall portion 61*a* is the same. Thus, when the reservoir formation member 23 is bonded while being pressed against the vibration plate 30, pressing force may be applied more evenly to each side of the first conductive wall portion 61*a*. Therefore, the sealability or effectiveness of seal around the first communication opening 42*a* may further be increased. Further, it is preferable that the drive wiring 35 disposed on the upstream of the one first conductive wall portion 61*a* in the sheet feeding direction and the drive wiring 35 disposed on the downstream of the one first conductive wall portion 61*a* in the sheet feeding direction be equally spaced from the first conductive wall portion 61*a*.

As depicted in FIG. 4, in areas where the piezoelectric elements 36 are not disposed, the common electrode 31, the insulating protective layers 37 and 38, and the drive wirings 35 are laminated in this order from the vibration plate 30 side. A portion of the common electrode 31 is disposed at an area around the communication opening 42 of the vibration plate 30. In other words, the conductive portion 62 of the conductive wall portion 61 and the common electrode 31 overlap with each other around the communication opening 42, via the protective layers 37 and 38. In this structure, an electric field (e.g., radiation noise) radiated from the drive wiring 35 toward the vibration plate 30 is interrupted by the common electrode 31 around the communication opening 42. Therefore, the electric field may be prevented or reduced from being spread out toward the channeled member 21.

If a particular conductive wall portion 61 disposed at an area around the communication opening 42 extends outside an edge of the pressure chamber 26 in plan view, an area to dispose the another drive wiring 35, which is not electrically connected to the conductive portion 62 of the particular conductive wall portion 61, is reduced by an amount or area that the particular conductive wall portion 61 extends outside the edge of the pressure chamber 26. In the illustrative embodiment, as depicted in FIGS. 3 and 4, the communication opening 42 and the conductive wall portion 61 are disposed inside edges of the pressure chamber 26, and disposed within the pressure chamber 26 in plan view. Therefore, a broader area to arrange the another drive wirings 35 may be ensured outside the pressure chambers 26.

As a pressure wave, occurring in the pressure chamber 26 as the piezoelectric element 36 is driven, leaks toward the reservoir 52, driving efficiency (e.g., efficiency of ejection energy applied to ink relative to electrical energy applied to the piezoelectric element 36) is reduced. To prevent or reduce the leakage of the pressure wave toward the reservoir 52 as much as possible, it is preferable to provide, at a portion of an ink supply channel from the reservoir 52 to the pressure chamber 26, a reduced portion having a greater flow resistance. As the diameter of the communication opening 42 disposed upstream of the pressure chamber 26 in an ink supply direction is reduced, the communication opening 42 functions as the reduced portion. Accordingly, leakage of the pressure wave from the pressure chamber 26 toward the reservoir 52 may be reduced or prevented.

Next, a method for manufacturing the head unit 12 of the inkjet head 4 will be described. FIGS. 5A-5D depict manufacturing processes of the head unit 12.

(a) Forming Laminated Body 22

Figure 5A:
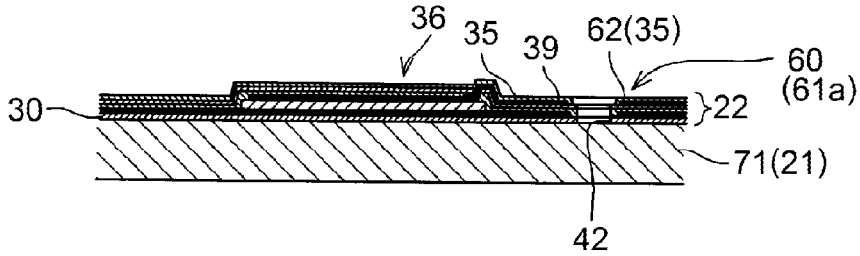
FIGS. 5A-5D illustrate manufacturing processes of the head unit.

As depicted in FIG. 5A, the laminated body 22 is formed on the upper surface of a silicon substrate 71, which becomes the channeled member 21. The laminated body 22 is formed using a known semiconductor process technique. To put it briefly, a film that becomes the respective layer of the laminated body 22 is sequentially formed, using a known film or layer formation technique, such as the spattering method or sol-gel method. Unnecessary portions of the film are removed at an appropriate timing, for example, by etching, to form the laminated body 22.

In a process of forming the laminated body 22 (e.g., an annular wall portion forming process), the annular wall portions 60 (e.g., the conductive wall portions 61) are formed at areas around the respective communication openings 42. More specifically, the annular conductive portions 62 are formed to surround the communication openings 42 at areas around the communication opening 42. Then, the conductive portions 62 are covered by the protective layer 39 formed of an insulating material. As described above, in the conductive wall portions 61 disposed around all of the first communication openings 42*a* and some of the second communication openings 42*b*, each conductive portion 62 constitutes a portion of the one drive wiring 35.

(b) Bonding Reservoir Formation Member 23

Figure 5B:
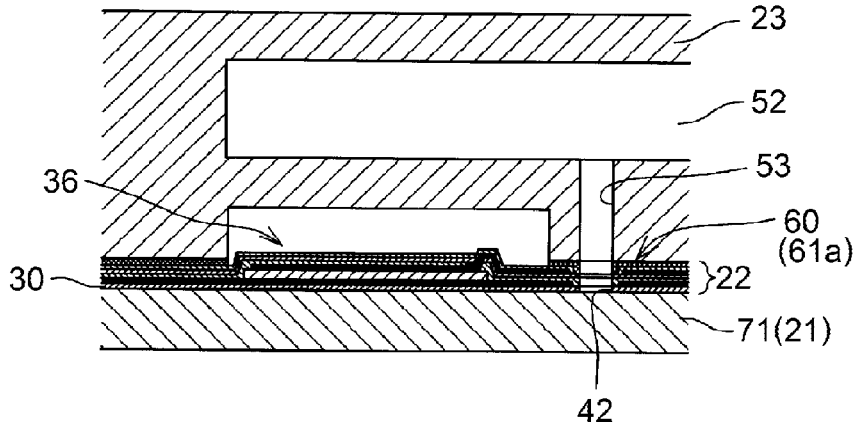

As depicted in FIG. 5B, the reservoir formation member 23 having the reservoirs 52 and ink supply channels 53 formed thereon is pressed against the upper surface of the laminated body 22 to bond with the thermosetting adhesive 45. At this time, the reservoir formation member 23 is bonded while being pressed against the annular wall portions 60 (e.g., the conductive wall portions 61) in areas around the communication openings 42. Thus, all perimeters of the reservoir formation member 23 may be reliably bonded at areas around the communication openings 42, and the sealability or effectiveness of seal may be preferable.

(c) Forming Channels in Channeled Member 21

Figure 5C:
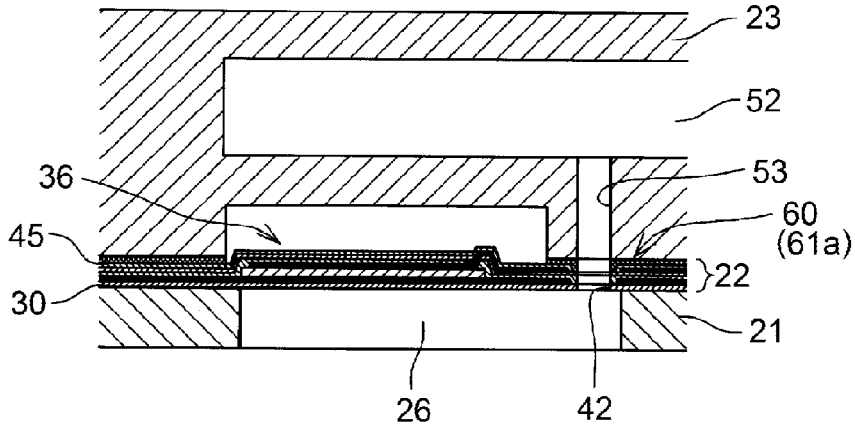

As depicted in FIG. 5C, channels, e.g., the pressure chambers 26, are formed on the silicon substrate 71, for example, by etching. Thus, the silicon substrate 71 becomes the channeled member 21.

As described above, in the illustrative embodiment, the conductive wall portion 61 is formed at a position within the corresponding pressure chamber 26 at an area around the respective communication opening 42. A portion of the vibration plate 30 extends inward with respect to edges of the pressure chamber 26. In this case, if the reservoir formation member 23 is bonded while being pressed against the conductive wall portions 61 after the pressure chambers 26 are formed on the channeled member 21, the channeled member 21 (e.g., the silicon substrate 71) might not bear the pressing force to the conductive wall portions 61. Therefore, a portion of the vibration plate 30 extending inwardly with respect to edges of the pressure chamber 26 may be damaged. In this regard, in the illustrative embodiment after the reservoir formation member 23 is bonded to the laminated body 22 including the vibration plate 30, as depicted in FIG. 5B, the pressure chambers 26 are formed on the channeled member 21 as depicted in FIG. 5C. In other words, when the reservoir formation member 23 is bonded as depicted in FIG. 5B, the pressure chambers 26 has not been formed on the channeled member 21 (e.g., the silicon substrate 71). Therefore, pressing force applied to the conductive wall portions 61 is received by the channeled member 21. Accordingly, the vibration plate 30 is less subjected to damages at the time of bonding the reservoir formation member 23.

(d) Bonding Nozzles Plate 20

Figure 5D:
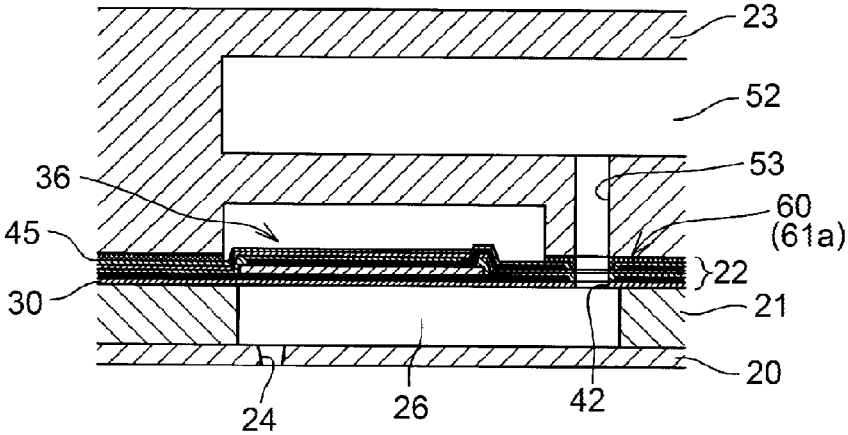

Lastly, as depicted in FIG. 5D, the nozzles plate 20 having the nozzles 24 formed thereon is bonded to the lower surface of the channeled member 21 with the adhesive 45.

In the above-described illustrative embodiment, the inkjet head 4 corresponds to a liquid ejection apparatus of the disclosure. The channeled member 21 and the nozzles plate 20 correspond to a first channeled structure of the disclosure. The nozzles 24 formed on the nozzles plate 20 and the pressure chambers 26 formed on the channeled member 21 correspond to a first liquid channel of the disclosure. The reservoir formation member 23 corresponds to a second channeled structure of the disclosure. The reservoir 52 and the ink supply channel 53 of the reservoir formation member 23 correspond to a second liquid channel of the disclosure. The drive contact portions 40 correspond to contact portions of the disclosure. A plurality of the individual electrodes 33 corresponds to a plurality of second electrodes of the disclosure. Portions of the common electrode 31 (e.g., portions contacting the active portion 32*a*) opposing the respective individual electrodes 33 correspond to a plurality of first electrodes of the disclosure.

Next, modifications of the above-described illustrative embodiment will be described. Like reference numerals denote like corresponding parts and detailed description thereof with respect to the following modifications will be omitted herein.

1] In the above-described illustrative embodiment, the annular wall portions 60 provided for the respective communication openings 42 are the conductive wall portions 61, each having the conductive portion 62. Among a plurality of the conductive wall portions 61, some of the conductive wall portions 61 include the conductive portions 62, each constituting a portion of the drive wiring 35. The rest of the conductive portions 62 of the conductive wall portions 61 are not electrically connected with the drive wirings 35 and are independent patterns. In another embodiment, each conductive portion 62 of all of the conductive wall portions 61 may constitute a portion of the drive wiring 35.

Figure 6:
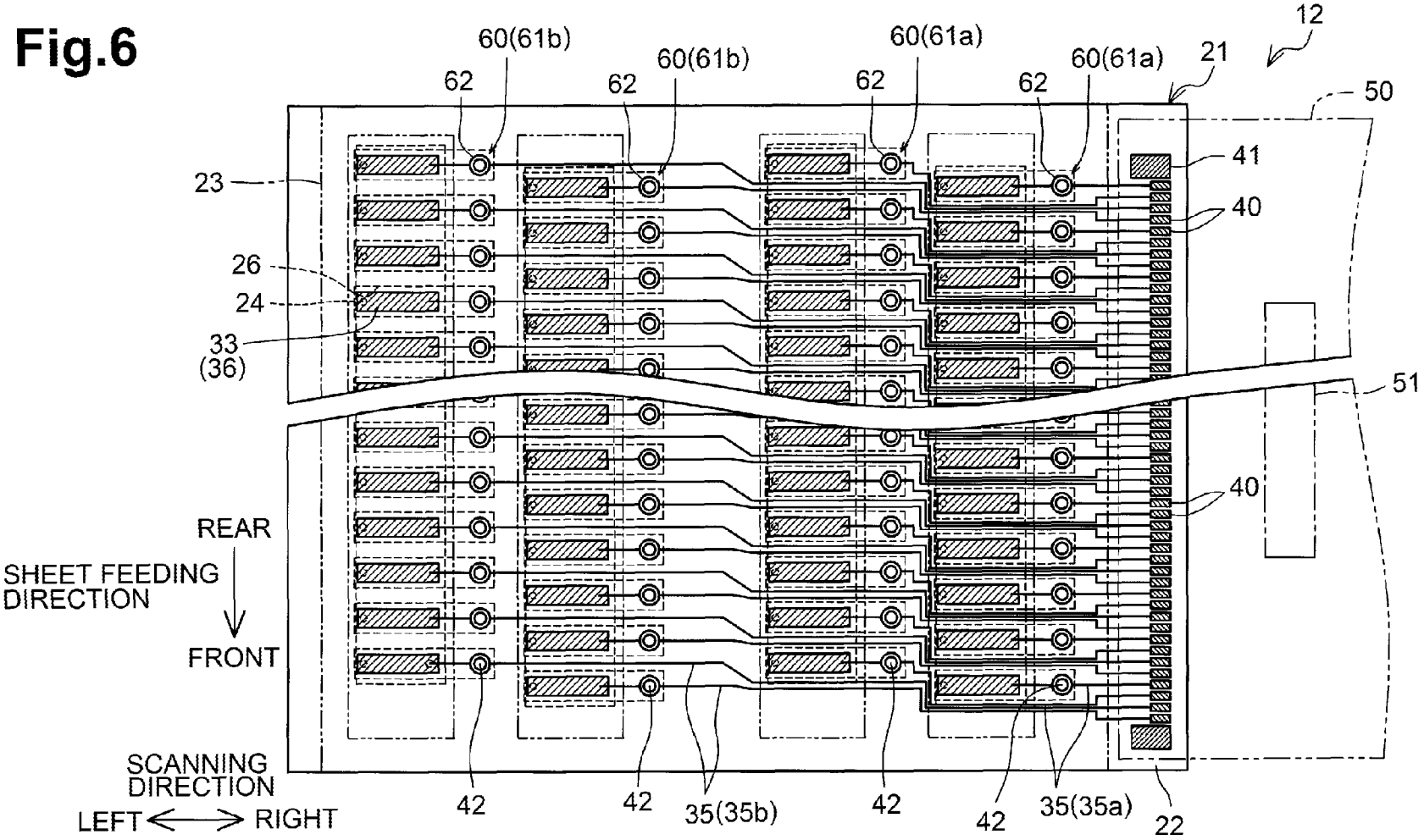
FIG. 6 is a top view of a head unit in a modification of the illustrative embodiment.

For example, in FIG. 6, the communication opening 42 corresponding to the piezoelectric element 36 and the conductive wall portion 61 are disposed to the right of each piezoelectric element 36. The drive wiring 35 extends rightward from each piezoelectric element 36. In this structure, the communication opening 42 corresponding to the respective piezoelectric element 36 is provided for all of the piezoelectric elements 36, at a portion of the drive wiring 35 extending rightward. Each conductive portion 62 of all conductive wall portions 61 constitutes a portion of the drive wiring 35. In other words, a portion of the drive wiring 35 is included in each of all conductive wall portions 61.

2] All of the annular wall portions 60 provided for the respective communication openings 42 do not have to include the conductive portions 62. In another embodiment, for example, some of the annular wall portions 60 might not include the conductive portions 62, but may consist of a layer of an insulating material.

Figure 7:
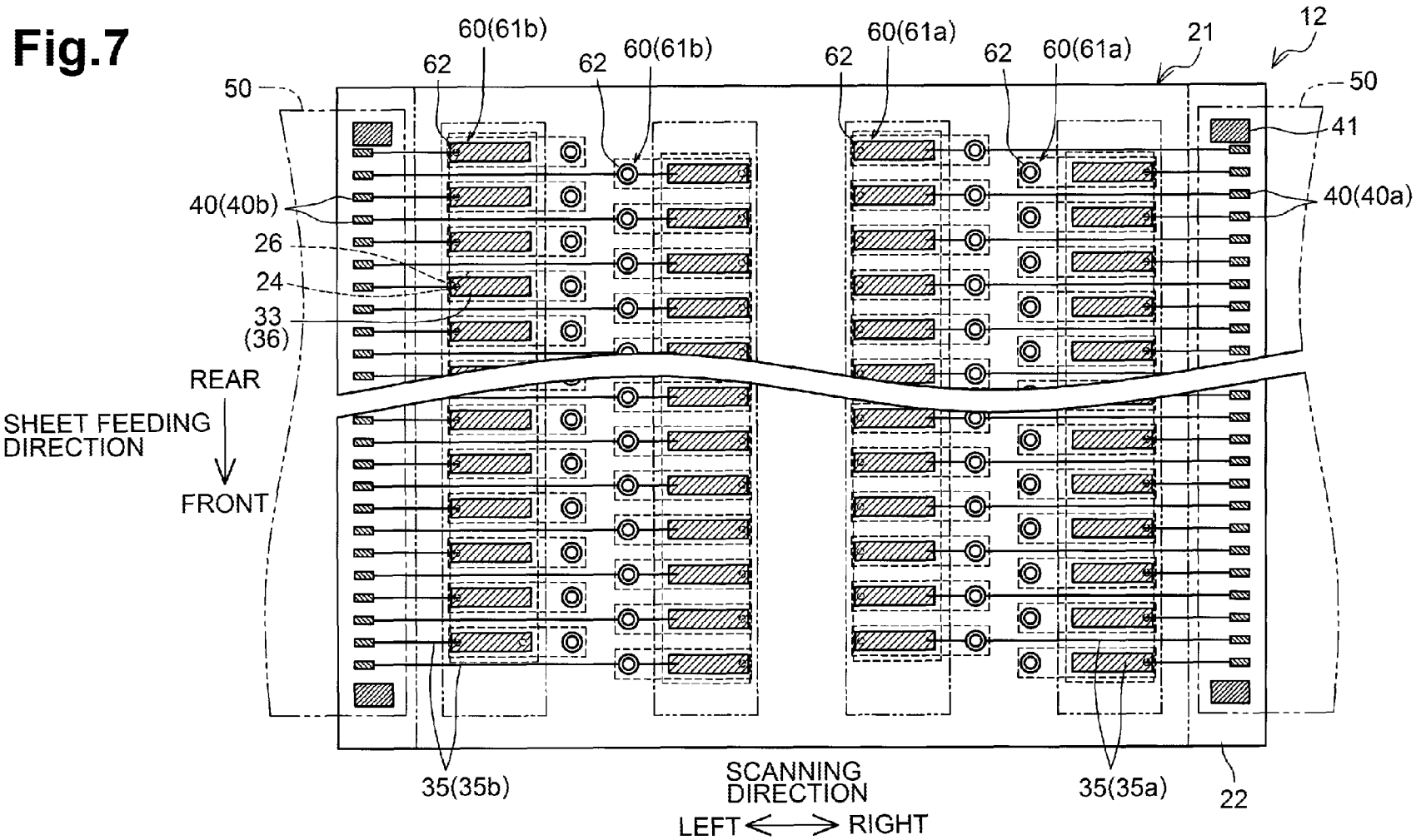
FIG. 7 is a top view of a head unit in another modification of the illustrative embodiment.

3] In the illustrative embodiment in FIG. 2 and the modification in FIG. 6, all of the drive wirings 35 connected to the respective piezoelectric elements 36 extend to the relevant drive contact portions 40 disposed to one side in the scanning direction. In another embodiment, as depicted in FIG. 7, the first drive contact portions 40*a* are disposed at a portion corresponding to a right end portion of the vibration plate 30. The second drive contact portions 40*b* are disposed at a portion corresponding to a left end portion of the vibration plate 30. Among the drive wirings 35 extending from the respective piezoelectric elements 36, the first drive wirings 35*a* may extend rightward, and the second drive wirings 35*b* may extend leftward. Thus, the drive wirings 35 may extend in each side in the scanning direction.

Figure 8A:
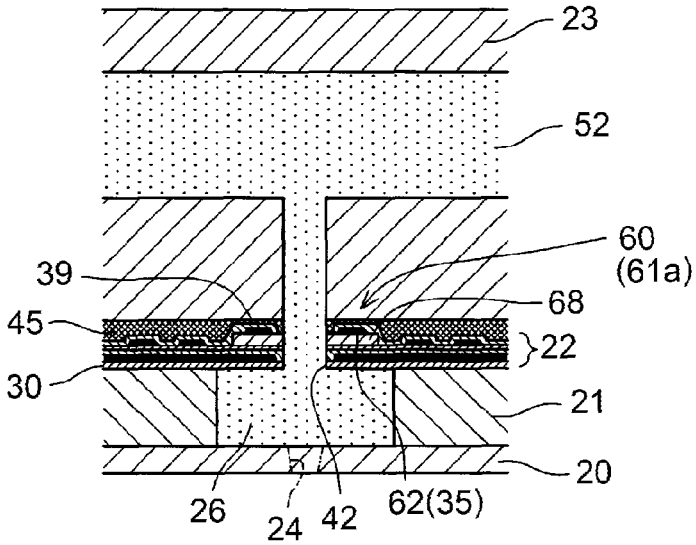
FIGS. 8A-8C are cross-sectional views of a head unit in yet another modification of the illustrative embodiment.

4] A cross-sectional structure of the conductive wall portion 61 is not limited to that described above in the illustrative embodiment. For example, as depicted in FIG. 8A, the conductive wall portion 61 may include a layer 68 formed of the same piezoelectric material as the piezoelectric layer 32 of the piezoelectric element 36. In this case, the layer 68 may be formed in the same film-forming process as the piezoelectric layer 32. The conductive wall portion 61 may include other layers of the laminated body 22 (e.g., the protective layers 37 and 38).

Figure 8B:
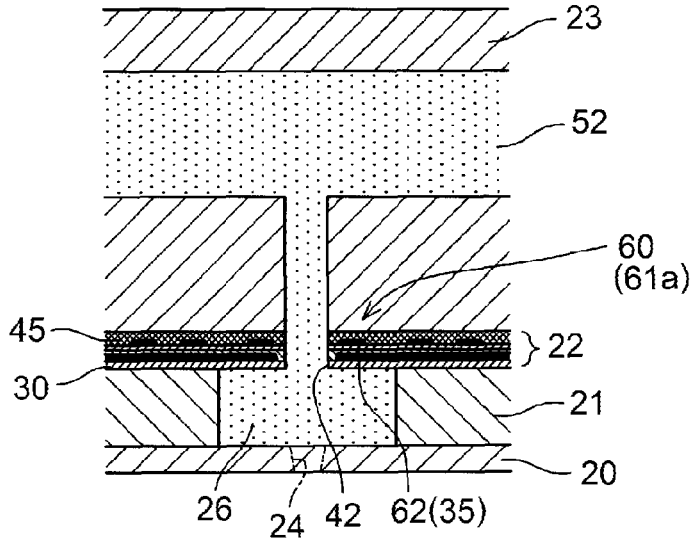

Alternatively, as depicted in FIG. 8B, the conductive wall portion 61 might not have to include the protective layer 39 covering the conductive portion 62, but may consist of the conductive portion 62. In this structure, as the conductive portion 62 is exposed, ink flowing through the communication opening 42 contacts the conductive portion 62, it may be preferable that the conductive portion 62 be covered by the adhesive 45 for bonding the reservoir formation member 23.

Figure 8C:
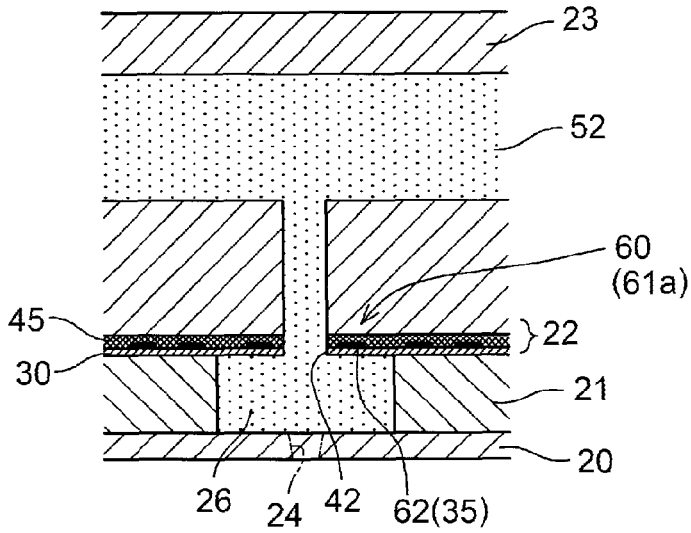

As depicted in FIG. 8C, the conductive wall portion 61 may be directly formed on the upper surface of the vibration plate 30. In other words, the common electrode 31 and the protective layers 37 and 38 might not have to be formed around the communication opening 42 of the vibration plate 30. In this case, the reservoir formation member 23 may be directly bonded to the upper surface of the vibration plate 30.

Figure 9A:
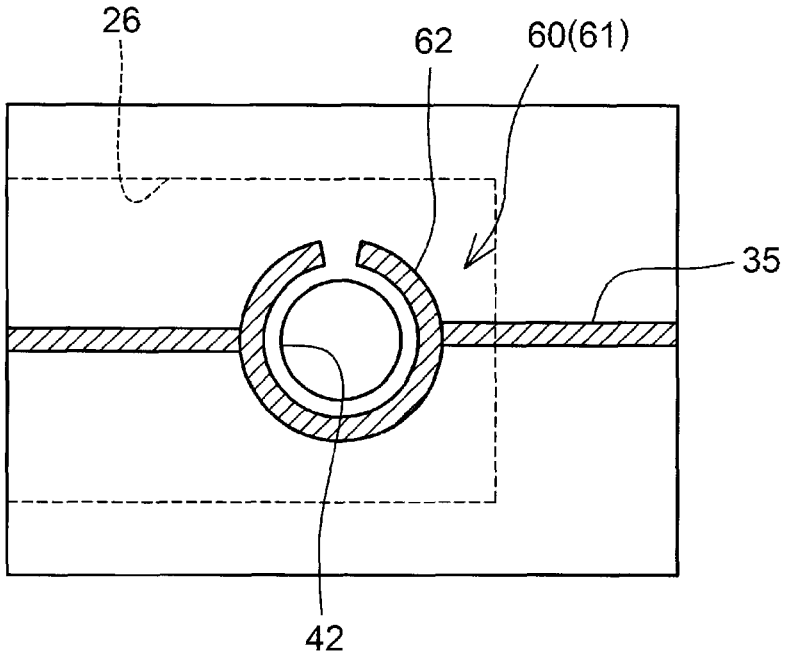
FIGS. 9A and 9B are a top view of a head unit in still another modification of the illustrative embodiment, illustrating a communication opening and its periphery.

5] The planar shape of the conductive portion 62 of the conductive wall portion 61 is not limited to that of the above-described illustrative embodiment. The conductive portion 62 does not have to completely surround the entire perimeter of the communication opening 42. In another embodiment, for example, the conductive portion 62 may partly surround three fourths (¾) of the perimeter of the communication opening 42 or greater (e.g., angular range of 270-360 degrees). Therefore, as depicted in FIG. 9A, the conductive portion 62 may have a generally C shape in plan view as a portion of the conductive portion 62 may be broken in its circumferential direction.

Figure 9B:
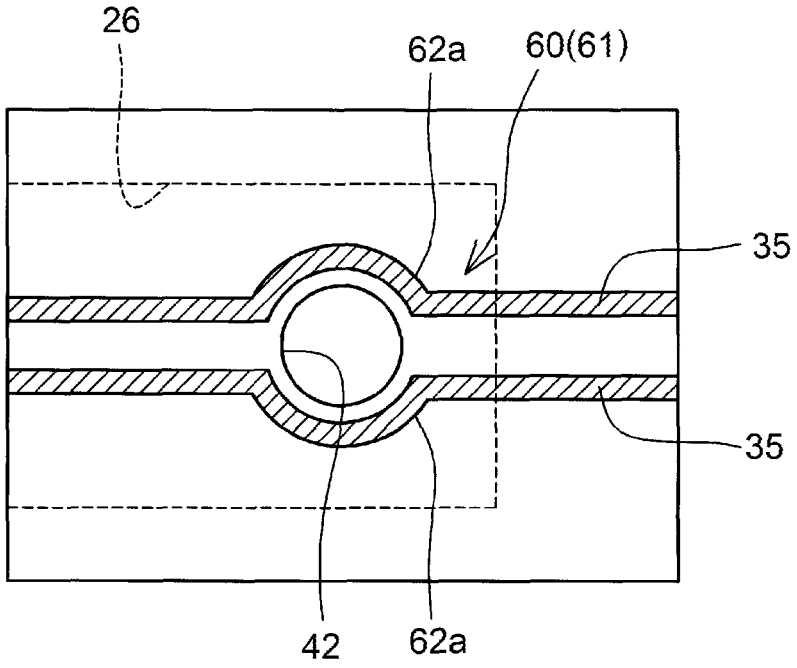

In the above-described illustrative embodiment, the conductive portion 62 of one conductive wall portion 61 includes a portion of one drive wiring 35. In another embodiment, the conductive portion 62 may include portions of two or more drive wirings 35. For example, in FIG. 9B, one conductive wall portion 61 may include two conductive pieces 62*a*, each of which constitute a portion of one drive wiring 35.

Figure 10:
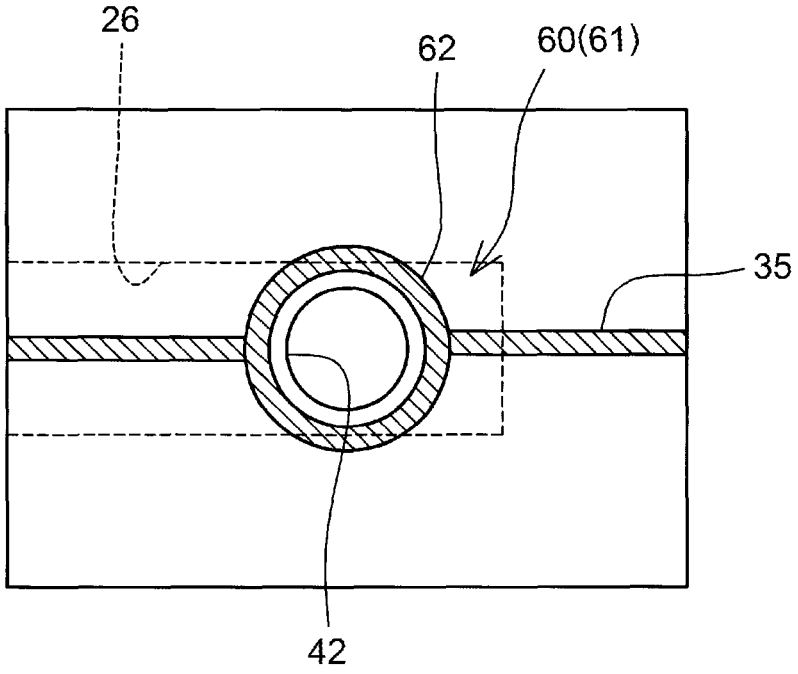
FIG. 10 is a top view of a head unit in still yet another modification of the illustrative embodiment, illustrating a communication opening and its periphery.

6] In the above-described illustrative embodiment, the conductive wall portion 61 disposed to surround the communication opening 42 is disposed within the pressure chamber 26 in plan view. In another embodiment, as depicted in FIG. 10, a portion of the conductive wall portion 61 may extend outside edges of the pressure chamber 26.

Figure 11:
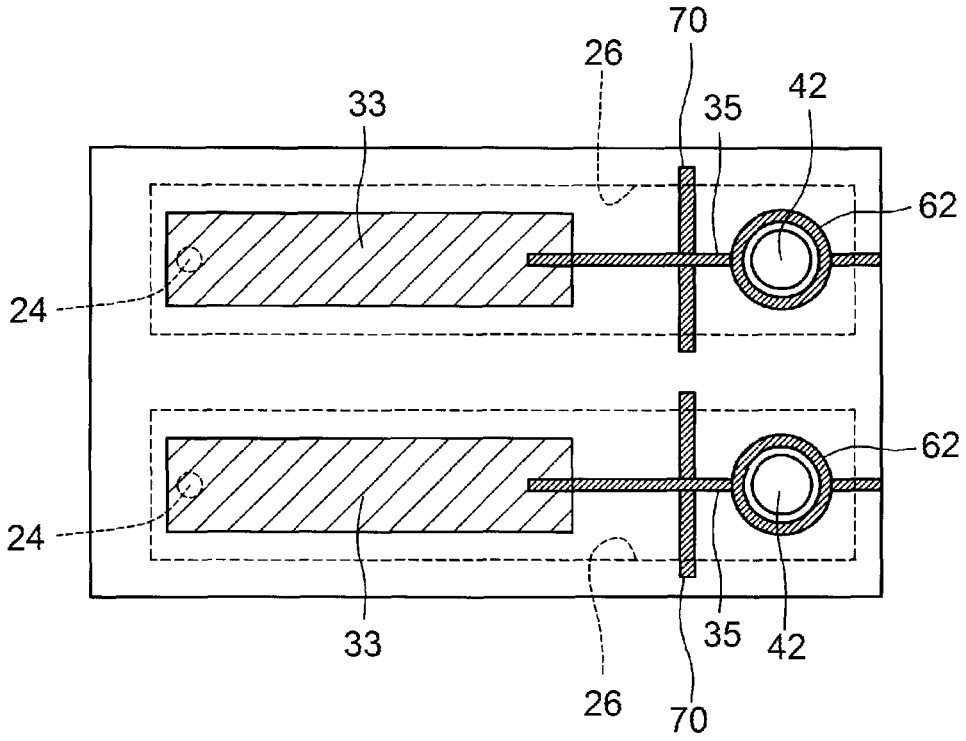
FIG. 11 is a partially enlarged top view of a head unit in a further modification of the illustrative embodiment.

7] As depicted in FIG. 11, a conductive pattern 70 extending in an arrangement direction of the pressure chambers 26 may be disposed at a portion of the drive wiring 35 between the individual electrodes 35 and the conductive portion 62 of the conductive wall portion 61. In this structure, flow of excessive adhesive 45 toward the individual electrodes 35 may be prevented or reduced when the reservoir formation member 23 is bonded with the adhesive 45 while being pressed against the conductive wall portions 61.

8] In the above-described illustrative embodiment, the COF 50 on which the driver IC 51 is mounted is bonded to the drive contact portions 40 formed on the upper surface of the laminated body 22 (refer to FIGS. 2 and 3). In another embodiment, the driver IC 51 may be directly mounted on the upper surface of the laminated body 22.

9] In the above-described illustrative embodiment, the channeled member 21 is formed of the silicon substrate 71. The laminated body 22 is formed on the silicon substrate 71 with a known semiconductor process technique. In another embodiment, the channeled member 21 may be formed of material other than silicon, e.g., a metallic material. When the channeled member 21 is formed of material other than silicon, the laminated body 22 manufactured in a different process may be bonded to the upper surface of the channeled member 21 with an adhesive.

10] In the above-described illustrative embodiment, the electrode disposed on a side of the piezoelectric layer 32 closer to the vibration plate 30 is the common electrode 31 to which the ground potential is applied. The electrode disposed on the other side of the piezoelectric layer 32 opposite to the vibration plate 30 relative to the piezoelectric layer 32 is the individual electrode 33 to which a drive signal is supplied. In another embodiment, the arrangement of the common electrode 31 and the individual electrode 33 may be reversed.

In the illustrative embodiment and its modifications, the disclosure is applied to an inkjet head configured to eject ink on a recording sheet to print, for example, an image. The disclosure may be applied to a liquid ejection apparatus to be used in a wide variety of uses other than an image printing. For example, the disclosure may be applied to a liquid ejection apparatus configured to eject conductive liquid on a substrate to form conductive patterns on a surface of the substrate.

What is claimed is:

1. A liquid ejection apparatus comprising:

a nozzle;

a pressure chamber communicating with the nozzle;

a laminated body including a piezoelectric element, the laminated body covering the pressure chamber, the laminated body defining a communications opening therethrough;

a reservoir communicating with the pressure chamber via the communication opening, wherein the reservoir is defined by a reservoir formation member, the reservoir formation member being bonded directly to the laminated body by an adhesive;

a wall extending around the communication opening, the wall including an upper surface and a conductive portion, wherein the adhesive contacts a lower surface of the reservoir formation member and the upper surface of the wall, such that the conductive portion of the wall is covered by the adhesive; and a drive contact electrically connected to the piezoelectric element by a conductor including the conductive portion of the wall.

2. A liquid ejection apparatus according to claim 1, further comprising:

a plurality of the nozzles;

a plurality of the pressure chambers, each pressure chamber communicating with a respective one of the nozzles;

a plurality of the communications openings defined by the laminated body, wherein the reservoir communicates with the plurality of pressure chambers via respective communications openings;

a plurality of the walls surrounding respective communications openings, each of the walls including a conductive portion;

a plurality of the piezoelectric elements;

a plurality of the drive contacts.

3. A liquid ejection apparatus according to claim 2, wherein:

a first one of the piezoelectric elements is electrically connected to a respective drive contact by a respective conductor including the conductive portion of the wall; and a second one of the piezoelectric elements is electrically connected to a respective drive contacts by a respective conductor that does not include the conductive portions of the wall.

4. A liquid ejection apparatus according to claim 1, wherein the conductive portion of the wall surrounds a perimeter of the communication opening.

5. A liquid ejection apparatus according to claim 2, wherein:

the pressure chambers are arranged in a first direction and constitute first and second pressure chamber rows, the first and second pressure chamber rows arranged in a second direction perpendicular to the first direction;

the piezoelectric elements are arranged in the first direction and constitute first and second piezoelectric element rows, the first and second piezoelectric element rows arranged in the second direction;

the communication openings are arranged in the first direction and constitute first and second communication opening rows, the first and second communication opening rows arranged in the second direction.

6. A liquid ejection apparatus according to claim 5, wherein the first communication openings row includes first and second adjacent communication openings, wherein first and second ones of the walls having the conductive portions surround the respective first and second adjacent communication openings, and wherein a conductor that is electrically insulated from the conductive portions of the walls surrounding the first and second adjacent communication openings is situated between the first and second adjacent communication openings.

7. A liquid ejection apparatus according to claim 5, wherein the first communication openings row includes a first communication opening, and wherein first and second conductors that are electrically insulated from the conductive portion of the wall surrounding the first communications opening are situated on opposite sides of the first communication opening.

8. A liquid ejection apparatus according to claim 1, further comprising an insulating layer covering the conductive portion of the wall.

9. A liquid ejection apparatus according to claim l, wherein the pressure chamber defines a periphery, and wherein the conductive portion of the wall is disposed within the periphery of the pressure chamber.

10. A liquid ejection apparatus according to claim 1, wherein the laminated body includes a vibration plate covering the pressure chamber, and wherein the piezoelectric element includes a piezoelectric layer, a first electrode disposed between the vibration plate and a first side of the piezoelectric layer and a second electrode disposed on a second side of the piezoelectric layer opposite to the first side.

11. A liquid ejection apparatus according to claim 10, wherein the first electrode is a common electrode, and the second electrode is an individual electrode electrically connected to the drive contact via the conductor including the conductive portion of the wall.

12. A liquid ejection apparatus according to claim 1, further comprising an insulating layer that covers the conductor and the conductive portion of the wall.

13. A liquid ejection apparatus according to claim 1, wherein the piezoelectric element includes a piezoelectric layer formed of piezoelectric material; and, the wall includes a layer formed of the same piezoelectric material as the piezoelectric layer.

14. A liquid ejection apparatus according to claim 1, wherein the wall includes an inner surface adjacent the communication opening and an outer wall spaced apart from the inner surface, and wherein the upper surface extends between the inner and outer surfaces.

15. A liquid ejection apparatus according to claim 1, wherein the wall is an annular wall.

16. A method for producing a liquid ejection apparatus, comprising;

forming a laminated body on a substrate, the laminated body having a first side and a second side opposite the first side, the laminated body including a piezoelectric element and defining a communications opening therethrough;

forming a wall around the communication opening, the wall including a conductive portion;

bonding a reservoir formation substrate directly to the first side of the laminated body by an adhesive, wherein the adhesive contacts a lower surface of the reservoir formation member and an upper surface of the wall, such that the conductive portion of the wall is covered by adhesive; and, forming a pressure chamber in the substrate, such that the second side of the laminated body covers the pressure chamber, wherein the reservoir communicates with the pressure chamber via the communication opening.

17. A method for producing a liquid ejection apparatus according to claim 16, wherein the pressure chamber is formed after the reservoir formation substrate is bonded to the laminated body.

18. A method for producing a liquid ejection apparatus according to claim 16, further comprising electrically connecting the piezoelectric element to a drive contact by a conductor that includes the conductive portion of the wall.

19. A method for producing a liquid ejection apparatus according to claim 16, wherein the conductive portion surrounds the communication opening.

20. A liquid ejection apparatus comprising:

a nozzle;

a pressure chamber communicating with the nozzle;

a laminated body including a piezoelectric element, the laminated body covering the pressure chamber, the laminated body defining a communications opening therethrough;

a reservoir communicating with the pressure chamber via the communication opening, wherein the reservoir is defined by a reservoir formation member, the reservoir formation member being bonded directly to the laminated body by an adhesive;

a drive contact, wherein the laminated body includes a conductor electrically connecting the drive contact to the piezoelectric element, wherein the conductor surrounds the communications opening, and wherein the adhesive contacts a lower surface of the reservoir formation member and the conductor such that the conductor is covered by the adhesive.

21. A liquid ejection apparatus according to claim 20, further comprising:

a wall extending from the laminated body so as to extend around the communication opening, wherein the wall includes the conductor.

* * * * *